United States Patent [19]

Volka

[11] 4,345,811

[45] Aug. 24, 1982

[54] FLAT RIBBON CABLE SHIELD

[75] Inventor: Lubomir J. Volka, Holbrook, N.Y.

[73] Assignee: Burroughs Corporation, Detroit, Mich.

[21] Appl. No.: 134,522

[22] Filed: Mar. 27, 1980

[51] Int. Cl.[3] ..... H01R 4/66; H01R 23/12; H01R 23/38

[52] U.S. Cl. ..... 339/143 R; 339/17 F; 339/176 MF; 174/35 C

[58] Field of Search ..... 339/14 R, 17 F, 176 MF, 339/97 P, 143 R; 174/117 F, 117 FF, 35 R, 35 C

[56] References Cited

U.S. PATENT DOCUMENTS

| | | | |
|---|---|---|---|
| 3,337,834 | 8/1967 | Godwin et al. | 339/14 L |
| 3,757,029 | 9/1973 | Marshall | 174/117 F X |
| 3,923,364 | 12/1975 | Shapiro et al. | 174/117 F X |
| 4,019,798 | 4/1977 | Zielinski | 339/17 F |
| 4,213,028 | 7/1980 | Wolf | 174/117 FF X |

*Primary Examiner*—Eugene F. Desmond
*Attorney, Agent, or Firm*—Mark T. Starr; Kevin R. Peterson; Edmund M. Chung

[57] ABSTRACT

A cable shield assembly for use with flat ribbon cable which protects electronic equipment and circuitry from the effects of electrostatic discharge.

15 Claims, 5 Drawing Figures

FLAT RIBBON CABLE SHIELD

BACKGROUND OF THE INVENTION

Among the most sensitive areas of electronic equipment to the effects of electrostatic discharge are the interconnecting cables and their respective terminations which are used between the pieces of electronic equipment.

These cables effectively act as receiving antennae to the broadband noise generated by an electrostatic arc and they then conduct this received signal, which is a disturbing influence, into the equipment circuitry. This introduction of these unwanted signals into the equipment is accomplished in spite of any shielding provided around the equipment consoles themselves. Such signals provide a disruptive effect on sensitive logic circuitry.

In the past, the most effective way to overcome the introduction of these signals has been to shield the offending cables with a suitable metallic envelope. This envelope was then electrically connected to the respective shields of the equipment at both ends of the cable.

This extended the shielding effect which existed around the pieces of electronic equipment, to the cables. Thus, a Gaussian shield or surface was created into which no outside electromagnetic radiation can penetrate so long as the shield was continuous.

With today's increasing usage of flat ribbon cable, plastic bodied connectors, which connectors can be "mass-terminated" to such cable, and non-metallic equipment enclosures, the problem of effective shielding against electrostatic discharge has risen anew. While there are various commercial ways of treating the non-metallic enclosures to provide an effective shield having metallic characteristics, heretofore, no known commercial way of shielding the "mass-terminated" flat ribbon cable existed.

SUMMARY OF THE INVENTION

It is therefore an object of the present invention to provide a means and a method of shielding flat ribbon cable.

It is a further object of this invention to provide a means and a method of shielding "mass-terminated" flat ribbon cable.

It is also an object of the present invention to provide a shielding mechanism for mass-terminated flat ribbon cable wherein the entire shielding connection is operator removable upon disengagement of the connector from the equipment.

It is a still further object of the present invention to provide a shielding system having a wide area connection to thereby improve the performance of the system against high-frequency, high-current transient interference signals.

These and other objects of the present invention will become apparent when the following detailed description is read in conjunction with the accompanying drawings and the appended claims.

IN THE DRAWINGS

DETAILED DESCRIPTION

Figure 1:
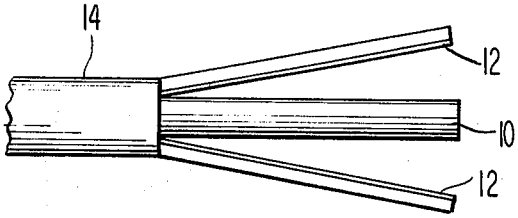
FIG. 1 illustrates the foil jacket surrounding the flat ribbon cable.

Referring now to FIG. 1, there is shown a flat ribbon cable 10 having a thin continuous metallic foil 12 which wraps around the cable longitudinally as opposed to a spiral wound wrap or a braided wrap found in some cables. In addition, the foil 12 is covered by a protective jacket 14 which protects the foil 12 as well as the cable 10.

The jacket 14 and foil 12 should be split and separated from the cable 10 an appropriate length back from the end of the cable.

Figure 2:
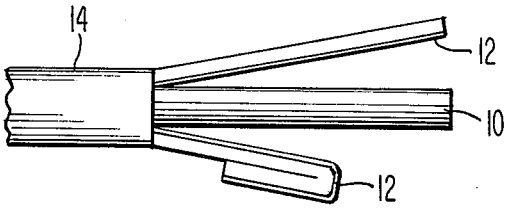
FIG. 2 illustrates the trimming and folding operation.

Next, as shown in the lower portion of FIG. 2, a piece of the jacket 14 is cut off, leaving the foil 12 intact. This section of foil 12 is then folded back around the end of the jacket to lay on the outside thereof.

Figure 3:
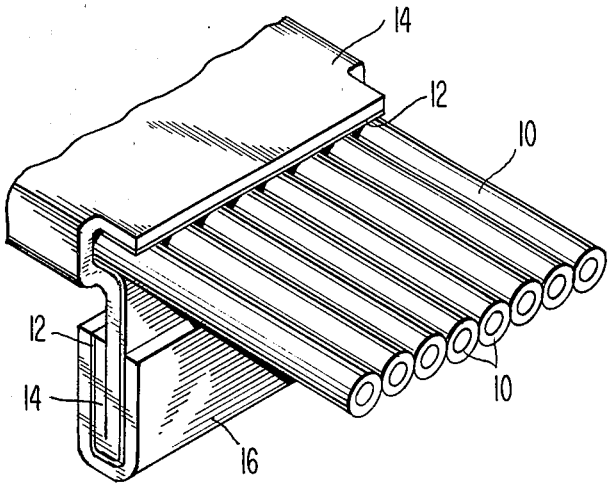
FIG. 3 illustrates the installation of the metallic clip over the folded foil jacket.

In FIG. 3, a metallic clip 16 is positioned over the folded back section of foil 12 and crimped thereon. This clip 16 not only serves as a contact means but also provides protection and strain-relief for the foil.

Figure 4:
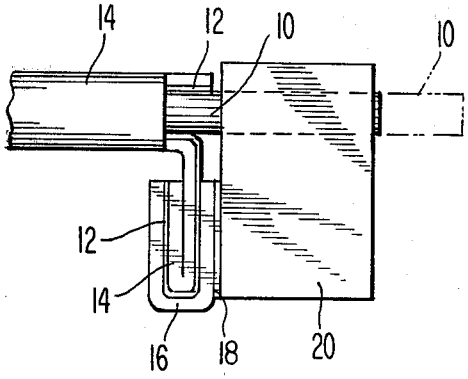
FIG. 4 illustrates the attachment of the shielded flat ribbon cable to a card edge connector.

As shown in FIG. 4, the cable 10 is now terminated by the desired card edge type connector 20. The connector 20 is positioned whereby the metallic clip 16 is attached to the connector 20 using double backed foam tape 18 of appropriate thickness. This attachment of cable termination to the connector 20 allows for a unified action during application and the flexibility of the foam tape maintains contact pressure.

Figure 5:
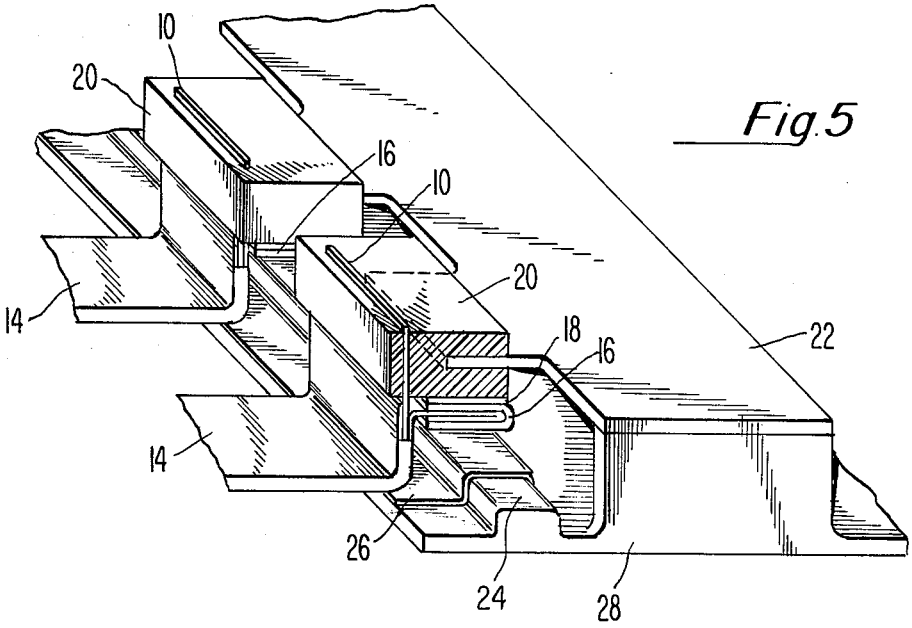
FIG. 5 shows the attachment of the card edge connector to the circuit card.

FIG. 5 illustrates the actual application of the connector 20 to the circuit card 22 which, in turn, is mounted to the equipment enclosure 28.

The enclosure 28, of course, must be designed to allow for a portion of the metallized surface 26 of the enclosure to contact the clip 16. In the present case, this is accomplished by a bump 24 which has a metallized coating 26 thereupon to contact the foil termination clip 16. The foam tape backing 18 provides pressure against the clip 16 to maintain good electrical contact between the clip 16 and the metallized surface 26 of bump 24. This completes the continuity of the enclosure shield 26 with the foil 12 on the flat cable 10 to thereby totally protect the circuits on the circuit card 22 from the effects of radio-frequency interference and electrostatic discharge.

Numerous variations of this basic concept are possible and it is intended that such variations are within the spirit and the scope of this invention as set forth in the following claims.

What is claimed is:

1. A shielding system for electronic equipment comprising:

an equipment enclosure means;

circuit mounting means mounted within said equipment enclosure means;

connector joining means included on said circuit mounting means;

a cable connector means attached to said connector joining means;

a cable means connected to said cable connector means;

a continuous electrically conductive shielding material covering said cable means;

a protective coating over said continuous electrically conductive shielding material;

a section of said electrically conductive shielding material folded back upon said protective coating;

an electrically conductive clip crimped upon said folded back section of said electrically conductive shielding material;

means attaching said electrically conductive clip to said cable connector means; and an electrically conductive protruding means on said equipment enclosure means adjacent to said connector joining means, wherein the electrically conductive protruding means contacts said electrically conductive clip upon the joining of said connector means to said connector joining means, thereby providing a cable means shielding system which is operator separable from said equipment enclosure means.

2. The shielding system of claim 1 wherein:

the circuit mounting means is a circuit card;

the connector joining means is of the card edge type; and the cable connecting means is a card edge connector.

3. The shielding system of claim 1 wherein the cable means is flat ribbon cable.

4. The shielding system of claim 1 wherein the attaching means is double backed foam adhesive tape.

5. The shielding system of claim 1 wherein said continuous electrically conductive shielding material is a metallic foil.

6. The shielding system of claim 5 wherein said electrically conductive protruding means is covered with a metallic material.

7. The shielding system of claim 1 wherein the interior surface of said equipment enclosure means is metalized, said metalized interior surface electrically connected to the electrically conductive protruding means.

8. The shielding system of claim 7 wherein the electrically conductive protruding means is a metalized bump on said equipment enclosure means, said bump adjacent to and in contact with the electrically conductive clip upon the joining of said connector means to said connector joining means, whereby a continuous shielding circuit is accomplished between the metalized interior surface of said enclosure means and the electrically conductive shielding material covering said cable means.

9. A shielding system for electronic equipment comprising:

an equipment enclosure means;

circuit mounting means mounted within said equipment enclosure means;

connector joining means included on said circuit mounting means;

a cable connector means attached to said connector joining means;

a cable means connected to said cable connector means;

at least one shield layer of electrically conductive material, said shield layer being disposed in generally longitudinal relationship with one side of said cable means;

a jacket of flexible insulating material encompassing said cable means and said shield layer;

a section of said shield layer folded back;

an electrically conductive clip crimped upon said folded back section of said shield layer;

means attaching said clip and said cable connector means; and an electrically conductive protruding means on said equipment enclosure means adjacent to said connector joining means, wherein the electrically conductive protruding means contacts said clip upon the joining of said connector means to said connector joining means, thereby providing a cable means shielding system which is operator separable from said equipment enclosure means.

10. The shielding system of claim 9 wherein:

the circuit mounting means is a circuit card;

the connector joining means is of the card edge type; and the cable connecting means is a card edge connector.

11. The shielding system of claim 9 wherein the cable means is flat ribbon cable.

12. The shielding system of claim 9 wherein said shield layer is fabricated from metallic foil.

13. The shielding system of claim 9 wherein the attaching means is an adhesive.

14. The shielding system of claim 9 wherein the interior surface of said equipment enclosure means is metalized, said metalized interior surface electrically connected to the electrically conductive protruding means.

15. The shielding system of claim 14 wherein the electrically conductive protruding means is a metalized bump on said equipment enclosure means, said bump adjacent to and in contact with the electrically conductive clip upon the joining of said connector means to said connector joining means, whereby a continuous shielding circuit is accomplished between the metalized interior surface of said enclosure means and the electrically conductive shielding material on said cable means.

* * * * *